US009551236B2

(12) United States Patent
Durand et al.

(10) Patent No.: US 9,551,236 B2
(45) Date of Patent: Jan. 24, 2017

(54) ARRANGEMENT FOR THE GUIDING OF THE FLOW OF A LIQUID IN RELATION TO THE ROTOR OF A TURBOMACHINE

(71) Applicant: SNECMA, Paris (FR)

(72) Inventors: Yannick Durand, Yebles (FR); Jean-Luc Soupizon, Vaux le Penil (FR)

(73) Assignee: SNECMA, Paris (FR)

( * ) Notice: Subject to any disclaimer, the term of this patent is extended or adjusted under 35 U.S.C. 154(b) by 864 days.

(21) Appl. No.: 13/739,320

(22) Filed: Jan. 11, 2013

(65) Prior Publication Data

US 2013/0183142 A1 Jul. 18, 2013

(30) Foreign Application Priority Data

Jan. 16, 2012 (FR) ..... 12 50412

(51) Int. Cl.
*F01D 25/18* (2006.01)
*F01D 25/16* (2006.01)

(52) U.S. Cl.
CPC ..... *F01D 25/18* (2013.01); *F01D 25/16* (2013.01); *F05D 2260/602* (2013.01); *F05D 2260/6022* (2013.01)

(58) Field of Classification Search
None
See application file for complete search history.

(56) References Cited

U.S. PATENT DOCUMENTS 8,051,952 B2 * 11/2011 Bart et al. ..... F01D 25/18 184/6.11
2005/0089399 A1 4/2005 Bart et al.
2005/0196088 A1 9/2005 Charier et al.
2007/0028590 A1 2/2007 Bart et al.
2008/0134657 A1 6/2008 DiBenedetto et al.
2009/0199534 A1 8/2009 Bart et al.

FOREIGN PATENT DOCUMENTS

EP 1 505 264 A1 2/2005
EP 1 577 495 A1 9/2005
EP 1 749 977 A1 2/2007
EP 1 936 123 A2 6/2008
EP 2 090 764 A1 8/2009

OTHER PUBLICATIONS

Preliminary French Search Report and Written Opinion Issued Aug. 24, 2012 in Patent Application No. 1250412 (with English translation of Categories of Cited Documents).

* cited by examiner

*Primary Examiner* — Igor Kershteyn
*Assistant Examiner* — Justin Seabe
(74) *Attorney, Agent, or Firm* — Oblon, McClelland, Maier & Neustadt, L.L.P.

(57) ABSTRACT

An arrangement for the guiding of the flow of a liquid in relation to the rotor of a turbomachine, which includes an intermediary disc and a downstream disc of which the internal diameter and the axial position of the discs are defined in such a way that the tank is arranged inside the discs. The rotor supports a guide flange with an element of revolution of which the diameter of the section increases in the downstream direction, according to the direction of flow of the gases in the turbomachine. The downstream axial end of the flange is fixed to a portion of the rotor located downstream of the downstream disc and the upstream axial end of the flange is connected to the internal radial end of the intermediate disc.

20 Claims, 6 Drawing Sheets

ARRANGEMENT FOR THE GUIDING OF THE FLOW OF A LIQUID IN RELATION TO THE ROTOR OF A TURBOMACHINE

TECHNICAL FIELD

The invention related to an arrangement for guiding the lubrication liquid in a turbomachine making it possible to prevent the liquid from reaching a predefined zone.

The invention proposes more particularly an arrangement for guiding the liquid overflowing from a buffer tank, in order to prevent it from reaching a hot zone of the rotor wherein the liquid would risk ignition.

PRIOR ART

A turbomachine, such as an aircraft turbojet comprises a stator and a rotor mounted in rotation in relation to the stator.

The turbomachine also comprises means for guiding the rotor in rotation in relation to the stator, which are lubricated continuously.

The lubrication system for these means of guiding comprises in particular a tank wherein the lubricant is received after it has been used.

The tank is supported by the stator and it is arranged in a hollow portion of the rotor, on the low pressure turbine of the turbomachine.

When the lubrication system is not in service, the tank fills until it overflows.

The overflow liquid then flows onto the rotor and it risks reaching a portion of the rotor which is located in the vicinity of the stream of circulation of hot gases. This portion is brought to a high temperature which can cause the combustion of the liquid when a certain quantity of liquid comes into contact with this portion of the rotor.

In order to prevent the liquid from reaching this portion of the rotor, it is known to use means for guiding the flow of the liquid towards a portion of the turbomachine located downstream of this hot portion of the rotor.

Document EP-A-2090764 describes such means for guiding the flow of the liquid.

However, the known embodiments of these means of guiding are particularly cumbersome. As such, the general volume and the mass of a turbomachine provided with such means of guiding are increased.

The invention has for purpose to propose means for guiding the lubrication liquid overflowing the tank, which are carried out in such a way as to have a reduced encumbrance in the turbomachine.

DESCRIPTION OF THE INVENTION

The invention proposes an arrangement for the guiding of the flow of a liquid, which flows from a tank of liquid mounted on the stator of a turbomachine, in relation to the rotor of the turbomachine, until a space separating the downstream end of the rotor and the stator, wherein the rotor comprises an intermediary disc and a downstream disc, located downstream of the intermediate disc, adjacent of revolution of which the external radial end edge of each disc carries vanes, of which the internal diameter and the axial position of the discs are defined in such a way that the tank is arranged inside said discs, and which comprises a guide flange for the liquid which is arranged between the tank and the discs, characterised in that the flange consists of an element of revolution which is supported by the rotor, of which the diameter of the section increases in the downstream direction, according to the direction of flow of the gases in the turbomachine, and which extends axially at least starting from the intermediate disc until the downstream disc.

Such a flange is mounted on the rotor, as close as possible to the discs of the rotor. Its encumbrance is consequently reduced, and it makes it possible to guide the lubrication liquid until the stream of gas.

More preferably, the downstream axial end of the flange is fixed to a portion of the rotor located downstream of the downstream disc and the upstream axial end of the flange is connected to the internal radial end of the intermediate disc.

More preferably, the rotor comprises a revolution flange extending axially in the downstream direction the external radial end of the downstream disc, said flange comprising the radially internal collar whereon the downstream end of the flange is fixed.

More preferably, the downstream end of the flange is fixed to said portion of the rotor by the intermediary of means of fastening of balancing weights of the rotor.

More preferably, the internal radial end of the intermediate disc comprises an annular groove open axially in the downstream direction wherein the upstream end of the flange is received.

More preferably, the flange comprises a tapered portion open axially in the downstream direction which extends axially in the downstream direction starting from the upstream end of the flange and a planar portion extending into a radial plane which connects the tapered portion to the downstream end of the flange. More preferably, the upstream axial end of the flange is connected to the internal radial end of the intermediate disc and the downstream axial end of the flange is fixed to the internal radial end of the downstream disc.

More preferably, the downstream axial end of the flange is fixed to the internal radial end edge of the downstream disc by the intermediary of means of blocking in rotation and means of blocking in translation in relation to the main axis A of the turbomachine.

More preferably, the means of blocking in rotation comprise a plurality of axial pins which are received in complementary orifices of the internal radial end of the downstream disc and of the downstream end of the flange.

More preferably, the means of blocking in translation comprise retaining rings which axially clamp the downstream end of the flange against the internal radial end of the downstream disc.

More preferably, the internal radial end of the intermediate disc comprises a revolution ring extending as a protrusion in the upstream direction in relation to the internal radial end of the intermediate disc, against an external annular surface from which the upstream end of the flange is radially engaged.

More preferably, the guide flange extends axially in the downstream direction starting from the intermediate disc, and in that the downstream axial end of the flange is located radially opposite and at a distance from an internal radial end surface of the downstream disc.

More preferably, the upstream axial end of the flange is fixed to the intermediate disc by screwing.

More preferably, the internal radial end of the intermediate disc is extended axially in the downstream direction by a revolution ring on the external cylindrical surface from which the upstream end of the flange is fixed.

More preferably, the radially internal surface of the revolution ring is of tapered shape, of which the diameter of the section increases in the downstream direction.

More preferably, the diameter of the section of the internal radial end surface of the downstream disc increases in the downstream direction.

More preferably, the downstream disc comprises a downstream spout which extends the internal radial end surface of the downstream disc and which is curved radially towards the exterior.

More preferably, the downstream axial end of the flange is located radially opposite and at a distance from an internal radial end surface of the most downstream disc and the upstream axial end of the flange is integral with the intermediate disc by the intermediary of means of fastening of the flange with the intermediate disc in rotation around the main axis of the turbomachine and by the intermediary of means of blocking in translation along the main axis of the turbomachine.

More preferably, the means of fastening of the flange in rotation with the intermediate disc comprise a first revolution portion which is a part of the intermediate disc and a second revolution portion which is a part of the upstream end of the flange which cooperate with each other.

More preferably, the first revolution portion and the second revolution portion are complementary and each comprise means of stopping in rotation.

More preferably, the means of blocking in translation comprise a retaining ring coaxial with the main axis of the turbomachine, which cooperates with the intermediate disc and with the upstream end of the flange.

More preferably, the retaining ring is received axially between a downstream end surface of the intermediate disc and a hook radially open towards the exterior which protrudes axially in the downstream direction in relation to said downstream surface of the intermediate disc, on the one hand, and the retaining ring is received axially between the portion of revolution of the flange and a radial collar of the flange protruding radially towards the interior in relation to the radially internal surface of the flange.

More preferably, the intermediate disc comprises a spout extending axially in the downstream direction, by extending in the downstream direction the radially internal surface of the intermediate disc, of which the downstream end of the spout is located axially downstream of the means of fastening.

More preferably, the flange is carried out by folding and/or stamping of a sheet.

More preferably, the guide flange extends axially in the downstream direction starting from a revolution wall of the rotor, and the downstream axial end of the flange is located axially on a downstream end edge of an internal radial end surface of the downstream disc, which is of rounded domed shape axially in the downstream direction and radially towards the interior.

More preferably, the flange comprises a tapered portion located between an upstream axial end and a downstream axial end of the flange, and the flange comprises at least one annular rib arranged on the radially external surface of the tapered portion.

More preferably, the stator comprises a casing delimiting a downstream portion of a stream of circulation of combustion gas, which is arranged downstream and at a distance from the rotor, and the downstream end of the flange is located axially on the axial space separating the rotor from the carter.

More preferably, the casing is connected to the stator by a radial revolution wall, the casing comprises a portion located upstream of the radial revolution wall, and located opposite the rotor, and said portion upstream comprises a drainage hole carried out on its lower end, in the direction of the gravity of the Earth.

The invention further proposes an aircraft turbomachine which comprises means for lubricating guiding elements in rotation of the rotor of the turbomachine in relation to the stator, and a tank for collecting lubrication liquid, characterised in that it comprises means of guiding the liquid overflowing from the tank towards an annular gas circulation stream, which are carried out as claimed in any preceding claim.

BRIEF DESCRIPTION OF THE DRAWINGS

Other characteristics and advantages of the invention shall appear when reading the following detailed description for the understanding of which reference shall be made to the annexed figures among which.

DETAILED DESCRIPTION OF PARTICULAR EMBODIMENTS

In the following description, identical, similar or analogous elements shall be designated by the same reference numbers.

Also, the axial direction from upstream to downstream is adopted as being the axial direction from the left to the right when referring to the figures.

Figure 1:
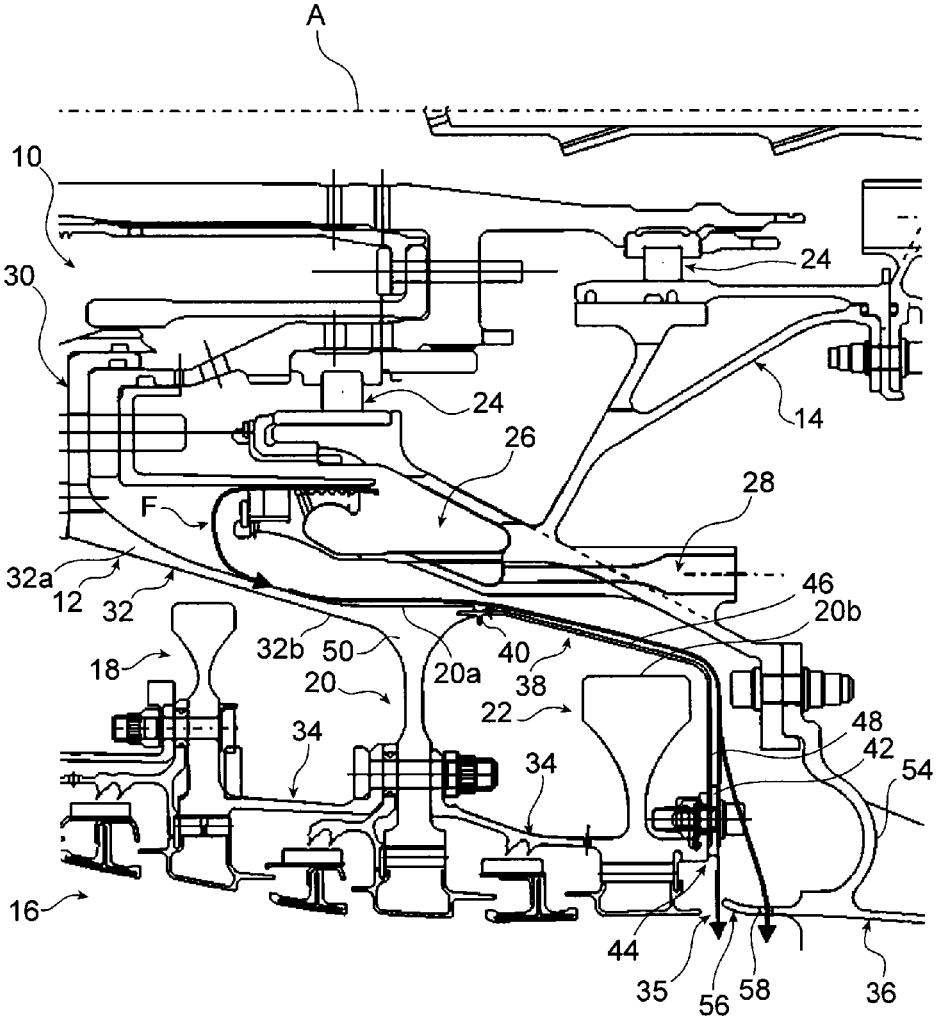
FIG. 1 is an axial section of a turbomachine comprising a system for guiding lubrication liquid overflowing from the retaining tank comprising a revolution flange according to the invention.

FIG. 1 shows a downstream portion of a turbomachine 10 such as an aircraft turbojet.

The downstream portion of the turbomachine 10 which is shown is located on a turbine referred to as "low pressure" of the turbomachine 10.

The turbomachine 10 comprises a rotor 12 and a stator 14 coaxial to the main axis A of the turbomachine 10. The rotor 12 is also mounted mobile in rotation in relation to the stator 14 around the main axis A.

The downstream portion of the rotor 12 comprises discs 18, 20, 22 for supporting mobile vanes of the turbine of the turbomachine 10. The vanes are mounted on the external radial end of each disc 18, 20, 22 and they are received in a stream 16 of circulation of combustion gas.

The discs 18, 20, 22 here are of a number of three, i.e. an intermediary disc 18, an intermediary disc 20 and a downstream disc 22. The intermediate disc 20 is as such the disc which is adjacent and which is located upstream of the downstream disc 22.

Each disc 18, 20, 22 consists of an element of revolution with a globally annular shape, i.e. it is open at its centre.

The discs 18, 20, 22 are aligned axially and they are furthermore offset axially and at a distance from one another.

The axial interval formed as such between the mobile vanes of the turbine receives fixed vanes of the turbine, which are mounted on the stator 14.

The discs 18, 20, 22 are elements manufactured separately and are assembled is such a way that they are stacked axially and are fixed mechanically by screwing.

Revolution portions 34, integrally formed with the upstream 18 and downstream 22 discs, respectively, are fixed to the intermediate disc 20 for the fastening of the discs 18, 20, 22 together.

The revolution portions 34 are located radially on the stream 16 of gas, i.e. on external radials ends of the discs 18, 20, 22.

The intermediate disc 20 is connected to a central portion 30 of the rotor 12 by a revolution wall 32 which here is of a globally tapered shape, of which the diameter of the upstream end 32*a* of the revolution wall 32 is less than the diameter of the downstream end 32*b* of the revolution wall 32.

Also, the diameter of the downstream end 32*b* of the revolution wall 32 is defined in such a way that the revolution wall 32 is connected to the internal radial end 50 of the intermediate disc 20 and in such a way that the radially internal surface of the revolution wall 32 is extended by the radially internal cylindrical wall 20*i* of the intermediate disc 20.

More preferably, the revolution wall 32 is integrally formed with the intermediate disc 20.

The rotor 12 is guided in rotation in relation to the stator 14 by the intermediary of conventional means of guiding, for example bearings 24.

A portion of the stator 14 is received inside the rotor 12 and is located axially on discs 18, 20, 22. The discs 18, 20, 22 are as such designed in such a way that their outside diameters are substantial enough to receive the stator 14 and the means for guiding 24.

Due to the substantial rotating speed of the rotor 12 in relation to the stator 14, the bearings 24 are lubricated continuously by a lubrication liquid.

This lubrication liquid continuously supplies each bearing 24 and it is then collected in a tank 26 then redirected towards a circuit for redistributing the liquid (not shown) by the intermediary of a duct 28 connected to the tank.

In the event of a failure of the circuit for redistributing the lubrication liquid, the tank 26 is filled progressively and, when it is full, it overflows. The overflow liquid then flows in the direction of the discs 18, 20, 22.

The turbomachine 10 comprises means for guiding the flow of the liquid in order to prevent the liquid from reaching the portions of the rotor 12 which are brought to a high temperature. These portions of the rotor are in particular the revolution portions 34 which connect the discs 18, 20, 22 together.

Indeed, if the lubrication liquid were to come into contact with high temperature portions, the liquid would risk igniting and consequently damage the turbomachine 10.

The means for guiding the flow of the liquid are mounted on the stator 12. They are carried out in such a way that, during the rotation of the rotor 12, the liquid flows in the downstream direction by centrifugal effect.

The means for guiding are furthermore carried out in such a way that the liquid flows to the stream 16 of gas. For this, the means for guiding are carried out in such a way as to guide the liquid to a space 35 separating the downstream end of the rotor 12 from the stator 14.

This space 35 consists of an axial play located between an annular flange 44 of the downstream end of the rotor 12 and a flange 36 of the stator 14 that delimits the stream 16, downstream of the turbine.

The annular flange 44 axially extends in the downstream direction an external radial end portion of the downstream disc 22 and its downstream radial end 44*a* forms a radial collar which is used in particular as a support for fastening dynamic balancing elements of the rotor.

The means for the guiding of the flow of the liquid comprise in particular the revolution wall 32 which is located upstream of the intermediate disc 20.

As such, as can be seen by the arrow F, the liquid flows on the revolution wall 32 then on the radially internal surface 20*a* of the intermediate disc 20.

Figure 2:
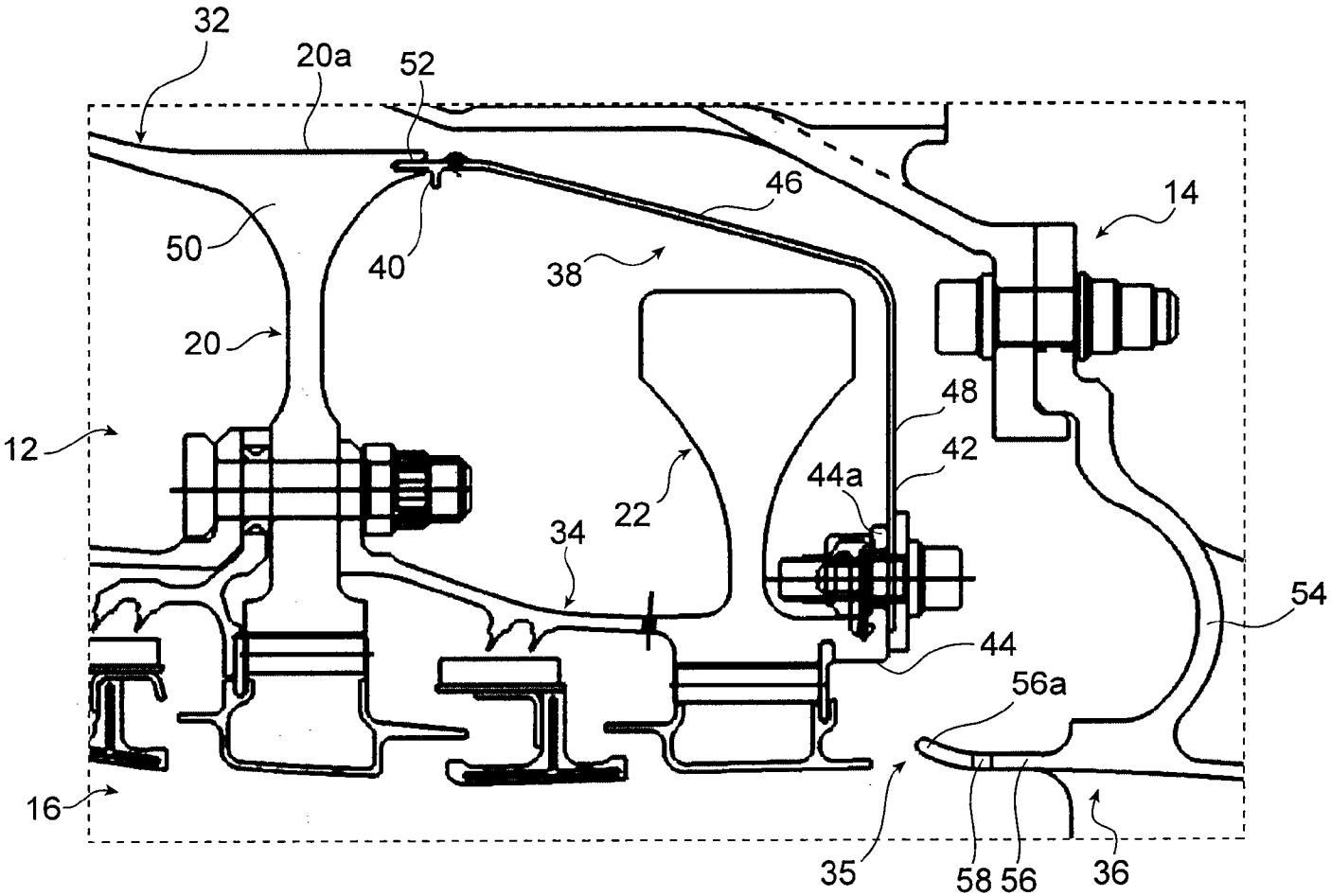
FIG. 2 is a detailed view on a larger scale of the turbomachine shown in FIG. 1, showing the method of fastening of the revolution flange.

As can be seen in more detail in FIG. 2, the means for guiding the flow of the liquid further comprise a revolution flange 38 which covers the zone located between the intermediate disc 20 and the downstream disc 22 and which is conformed in such a way as to extend in the downstream direction the radially internal surface 20*a* of the intermediate disc 20.

The diameter of the section of the flange 38 increases in the downstream direction, in such a way that the liquid flows in the downstream direction during the rotation of the rotor 12.

The flange 38 is furthermore fixed to the rotor 12 in such a way that the upstream axial end 40 of the flange 38 extends the internal radial end surface 20*a* of the intermediate disc 20 and the downstream axial end 42 of the flange 38 is fixed to the annular flange 44 of the downstream end of the rotor 12.

The flange 38 comprises a tapered portion 46 which extends axially from the upstream end 40 to an axial dimension located on the radial collar 44*a* of the annular flange 44, i.e. beyond the axial dimension of the downstream disc 22.

The radial dimensions of the tapered portion 46 are furthermore defined in such a way that they are less than the internal radius of the downstream disc 22 in such a way that the tapered portion 46 covers the zone located between the intermediate disc 20 and the downstream disc 22 and also covers the downstream disc 22.

The tapered portion 46 is extended by a planar portion 48 extending into a radial plane which connects the tapered portion 46 to the downstream end 42 of the flange 38.

The fixation of the flange 38 onto the rotor 12 is carried out by screwing the downstream end 42 of the flange with the annular crown 44.

More preferably, the screwing is carried out by the fastening screws of the means for dynamic balancing of the rotor 12.

The upstream end 40 of the flange 38 is connected to the internal radial end 50 of the intermediate disc 20, it is inserted axially into an annular groove 52 open axially in the downstream direction.

The flange 38 consists of a sheet which has been folded and/or stamped in order to have the shape that was defined beforehand. Such an embodiment is relatively simple and the final weight of the flange is relatively reduced.

As such, the liquid which overflows from the tank flows successively along the revolution wall 32, along the radially internal surface 20*a* of the intermediate disc 20, then along the tapered portion 46 of the flange 38.

Then, according to the rotating speed of the rotor 12, the liquid flows either along the planar portion 48 of the flange 38, or the liquid is projected in the downstream direction and radially towards the exterior in the direction of the casing 36 of the stator 14.

Figure 3:
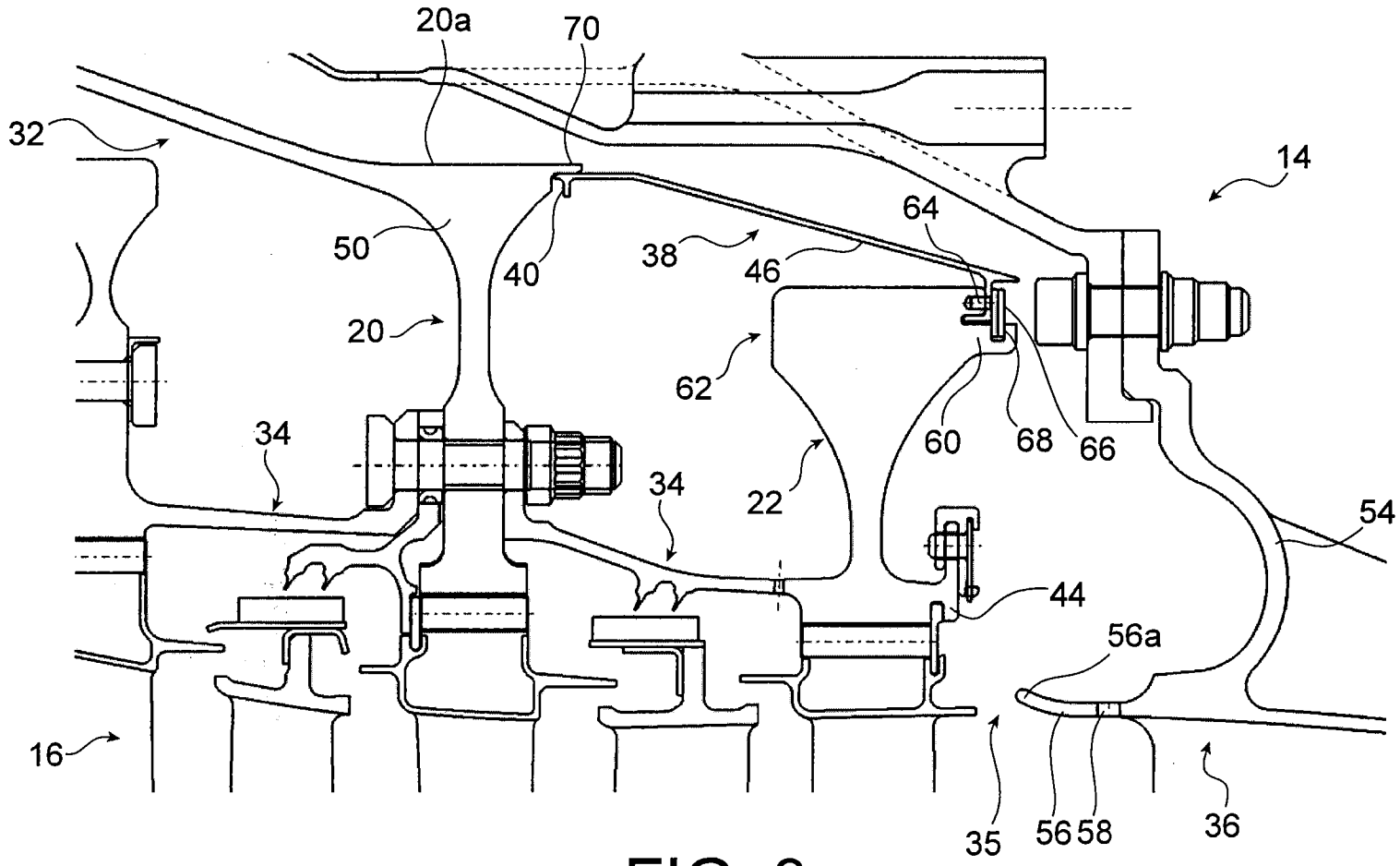
FIG. 3 is a view similar to that of FIG. 1, showing a second embodiment of the revolution flange.

FIG. 3 shows another embodiment of the revolution flange 38 that covers the zone located between the intermediate disc 20 and the downstream disc 22 and which is shaped in such a way as to extend in the downstream direction the radially internal surface 20*a* of the intermediate disc 20.

According to this embodiment, the flange 38 is fixed to the rotor 12 in such a way that the upstream axial end 40 of the flange 38 extends the internal radial end surface 20*a* of the intermediate disc 20 and the downstream axial end 42 of the flange 38 is fixed to the downstream disc 22.

Here, the downstream axial end 42 of the flange 38 is located on a downstream portion 60 of the internal radial end 62 of the downstream disc 22.

The fastening of the flange 38 onto the rotor 12 is carried out by making integral the downstream end 42 of the flange 38 with the downstream disc 22.

Here, the downstream end 42 of the flange 38 is integral with the downstream end portion 60 of the internal radial end 62 of the downstream disc 22 by the intermediary of means of blocking in rotation combined with means of blocking in translation, in relation to the main axis A of the turbomachine.

The blocking in rotation is carried out by the intermediary of pins 64 parallel to the main axis A of the turbomachine 10, which are received in orifices associated with the downstream end 60 of the downstream disc 22 and which are distributed around the main axis A.

The blocking in axial translation is carried out by the intermediary of retaining rings 66 which are received in a groove 68 radially open towards the interior, which is carried out in the downstream end 60 of the downstream disc 22.

The downstream end 42 of the flange is as such clamped axially between the retaining rings 66 and the downstream end 60 of the downstream disc 22.

The upstream end 40 of the flange 38 is connected to the internal radial end 50 of the intermediate disc 20, it is radially engaged towards the interior against an external annular surface of a revolution ring 70 extending in a protruding manner in the upstream direction in relation to the internal radial end 50 of the intermediate disc 20.

The flange 38 consists of a sheet which has been folded and/or stamped in order to have the shape that was defined beforehand. Such an embodiment is relatively simple and the final weight of the flange is relatively reduced.

As such, the liquid which overflows from the tank flows successively along the revolution wall 32, along the radially internal surface 20*a* of the intermediate disc 20, then along the flange 38.

Then, according to the rotating speed of the rotor 12, the liquid is projected radially towards the exterior towards the radial play 35 between the rotor and the stator 14, or the liquid is projected in the downstream direction and radially towards the exterior in the direction of the casing 36 of the stator 14.

Figure 4:
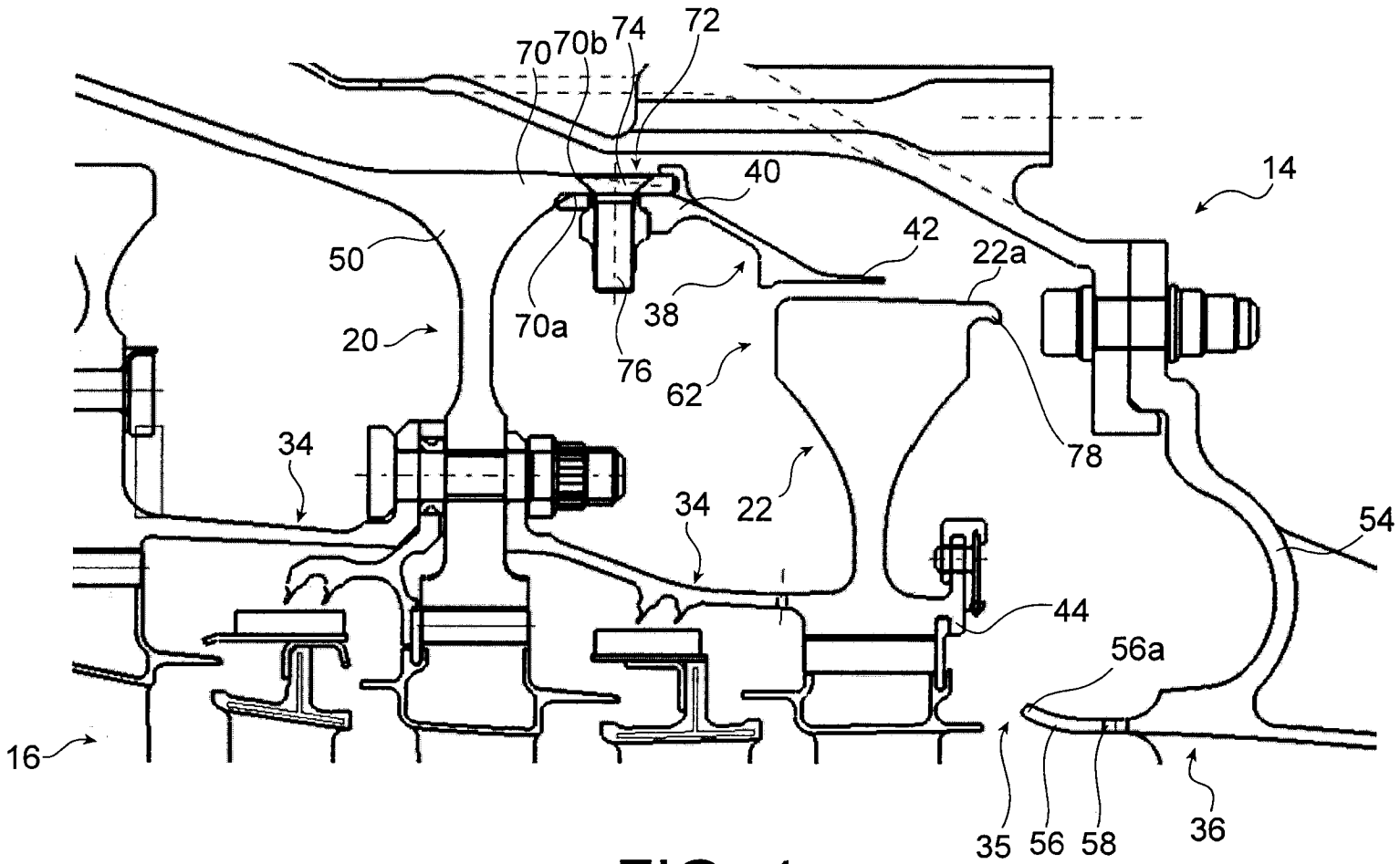
FIG. 4 is a view similar to that of FIG. 1, showing a third embodiment of the revolution flange.

FIG. 4 shows another embodiment of the revolution flange 38 which is shaped in such a way as to extend in the downstream direction the radially internal surface 20*a* of the intermediate disc 20.

The flange 38 is furthermore fixed to the rotor 12 in such a way that the upstream axial end 40 of the flange 38 extends the internal radial end surface 20*a* of the intermediate disc 20 and the downstream axial end 42 of the flange 38 is located radially opposite and at a distance from a internal radial end surface 22*a* of the downstream disc 22.

The fastening of the flange 38 onto the rotor 12 is carried out by screwing the upstream end 40 of the flange 38 onto the intermediate disc 20.

For this, the internal radial end 50 of the intermediate disc 20 is extended in the downstream direction by a revolution ring 70 on the radially external surface 70*a* from which the upstream end 40 of the flange 38 is fixed. The revolution ring 70 is carried out in such a way that its radially internal surface 70*b* axially extends in the downstream direction the radially internal surface 20*a* of the intermediate disc 20.

As such, the radially internal surface 70*b* of the revolution ring 70 is globally tapered, i.e. the diameter of its section increases in the downstream direction.

The fixation of the flange 38 on the revolution ring 70 by screwing is carried out by the intermediary of screws 72 which are oriented radially in such a way that the head 74 of each screw 72 is radially engaged towards the exterior against the revolution ring 70. As such, the rod 76 of each screw extends inside the space delimited by the intermediate disc 20 and the downstream disc 22.

In order to avoid hindering the flow of the liquid, the revolution ring 70 comprises a counter-bore which receives the head of each screw 72 and which is of a shape complementary to the shape of the head 74 of the associated screw 72.

As such, the head 74 of each screw 72 is flush with the radially internal surface 70*b* of the revolution ring 70.

As was mentioned hereinabove, the downstream axial end 42 of the flange 38 is located radially opposite and at a distance from the internal radial end surface 22*a* of the downstream disc 22.

As such, the liquid flows from the downstream axial end 42 of the flange 38 onto the internal radial end surface 22*a* of the downstream disc 22.

In order to facilitate the flow of the liquid in the downstream direction, the internal radial end surface 22*a* of the downstream disc 22 is of a globally tapered shape open in the downstream direction, i.e. the diameter of the section of the internal radial end surface 22*a* of the downstream disc 22 increases in the downstream direction.

Also, the downstream disc 22 comprises a spout 78 which extends in the downstream direction the internal radial end surface 22*a* of the downstream disc 22.

The spout is curved radially towards the exterior and its free end is located axially on the space 35 between the downstream end annular flange 44 of the rotor 12 and the flange 36.

The spout 78 covers primarily the annular flange 44. As such, the liquid flows into the space 35 between the flange 44 and the casing 36. According to the rotating speed of the rotor 12, the liquid can also be projected in the downstream direction and radially towards the exterior in the direction of the casing 36 of the stator 14.

Figure 5:
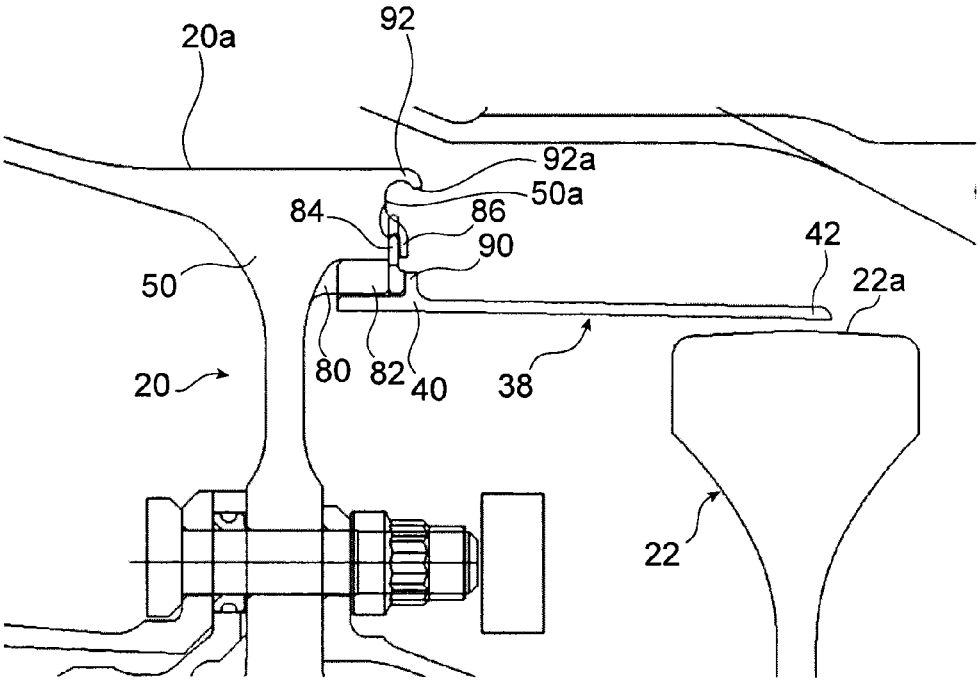
FIG. 5 is a view similar to that of FIG. 1, showing a fourth embodiment of the revolution flange.

FIG. 5 shows another embodiment of the revolution flange 38 which is shaped in such a way as to extend in the downstream direction the radially internal surface 20*a* of the intermediate disc 20.

The flange 38 is furthermore fixed to the rotor 12 in such a way that the upstream axial end 40 of the flange 38 is located in the extension of the internal radial end surface 20*a* of the intermediate disc 20 and the downstream axial end 42 of the flange 38 is located radially opposite and at a distance of an internal radial end surface 22*a* of the downstream disc 22.

The fastening of the flange 38 to the rotor 12 is carried out by making integral the upstream end 40 of the flange 38 on the internal radial end 50 of the intermediate disc 20.

The means of fastening of the flange 38 onto the intermediate disc 20 comprise on the one hand means of fastening the upstream end 40 of the flange 38 with the intermediate disc 20 in rotation around the main axis A of the turbomachine and comprise, on the other hand, means of blocking in translation the upstream end 40 of the flange 38 in relation to the intermediate disc 20.

The means of fastening of the upstream end 40 of the flange 38 in rotation with the intermediate disc 20 consist of a coupling of the so-called "clutch" type, which comprises a first revolution portion 80 which is a part of the internal radial end 50 of the intermediate disc 20, and a second revolution portion 82 which is a part of the upstream end 40 of the flange 38.

The first revolution portion 80 and the second revolution portion 82 are complementary and cooperate with each other. They comprise means of stopping in rotation, such as for example a plurality of teeth distributed around the main axis A of the turbomachine 10.

Here, the first revolution portion 80 extends radially towards the exterior starting from the internal radial end 50 of the intermediate disc 20 and the second revolution portion 82 extends radially towards the interior starting from the upstream end 40 of the flange 38.

The revolution portions 80, 82 also carry out the positioning of the flange 38 in relation to the internal radial end 50 of the intermediate disc 20, coaxially to the main axis of the turbomachine 10.

The blocking in axial translation of the flange 38 in relation to the internal radial end 50 of the intermediate disc 20 is carried out by the intermediary of a retaining ring 84 coaxial to the main axis A, which cooperates simultaneously with the internal radial end 50 of the intermediate disc 20 and with the upstream end 40 of the flange.

The radially internal end of the retaining ring 84 is as such received axially between a downstream axial end surface 50*a* of the internal radial end 50 of the intermediate disc 20 and a hook 86 open radially towards the exterior which protrudes axially in the downstream direction in relation to the downstream surface 50*a* of the internal radial end 50 of the intermediate disc 20, as such defining a groove radially open towards the exterior which receives the retaining ring 84.

The external radial end of the retaining ring 84 is received axially between the revolution portion 82 of the flange 38 and a radial collar 90 of the flange 38 protruding radially towards the interior in relation to the radially internal surface of the flange, as such defining a groove radially open towards the interior which receives the retaining ring 84.

In order to prevent the liquid from flowing onto the means of fastening the upstream end 40 of the flange 38, from the radially internal surface 20*a* of the intermediate disc 20, the internal radial end 50 of the intermediate disc 50 comprises a spout 92 extending axially in the downstream direction, by extending in the downstream direction the radially internal surface 20*a* of the intermediate disc 20.

The spout 92 is curved radially towards the exterior and its downstream end 92*a* is located axially in the downstream direction beyond the means of fastening. As such, the liquid flows on the radially internal surface of the flange, downstream of the means of fastening.

As was mentioned hereinabove, the downstream axial end 42 of the flange 38 is located radially opposite and at a distance from the internal radial end surface 22*a* of the downstream disc 22.

As such, the liquid flows from the downstream axial end 42 of the flange 38 onto the internal radial end surface 22*a* of the downstream disc 22.

In order to facilitate the flow of the liquid in the downstream direction, the internal radial end surface 22*a* of the downstream disc 22 is of a globally tapered shape open in the downstream direction, i.e. the diameter of the section of the internal radial end surface 22*a* of the downstream disc 22 increases in the downstream direction.

According to the rotating speed of the rotor 12, the liquid can also be projected in the downstream direction and radially towards the exterior in the direction of the casing 36 of the stator 14.

The casing 36 is shaped in such a way as to capture the portion of the liquid which is projected and to redirect it towards the stream 16.

The casing 36 is in particular connected to the rest of the stator 14 by the intermediary of a revolution wall 54 with a primarily radial orientation. The casing 36 further comprises a revolution portion 56 located upstream of the revolution wall 54 which is located opposite the downstream flange 44 of the rotor 12.

The upstream axial end 56*a* of the upstream portion 56 is curved radially towards the interior, forming an element for retaining the liquid.

The upstream portion 56 comprises a drainage orifice 58 located on its lower end, in the direction of the gravity of the Earth, this drainage orifice 58 opens into the stream 16 in such a way that the liquid collected as such is evacuated into the stream, as shown in FIG. 1 by the right portion of the arrow F.

By the intermediary of the flange 38, the overflow liquid is guided in the direction of the stream 16 of circulation of hot gases.

The liquid can then burn in contact with these hot gases, without the risk of damaging the components of the turbomachine 10.

Figure 6:
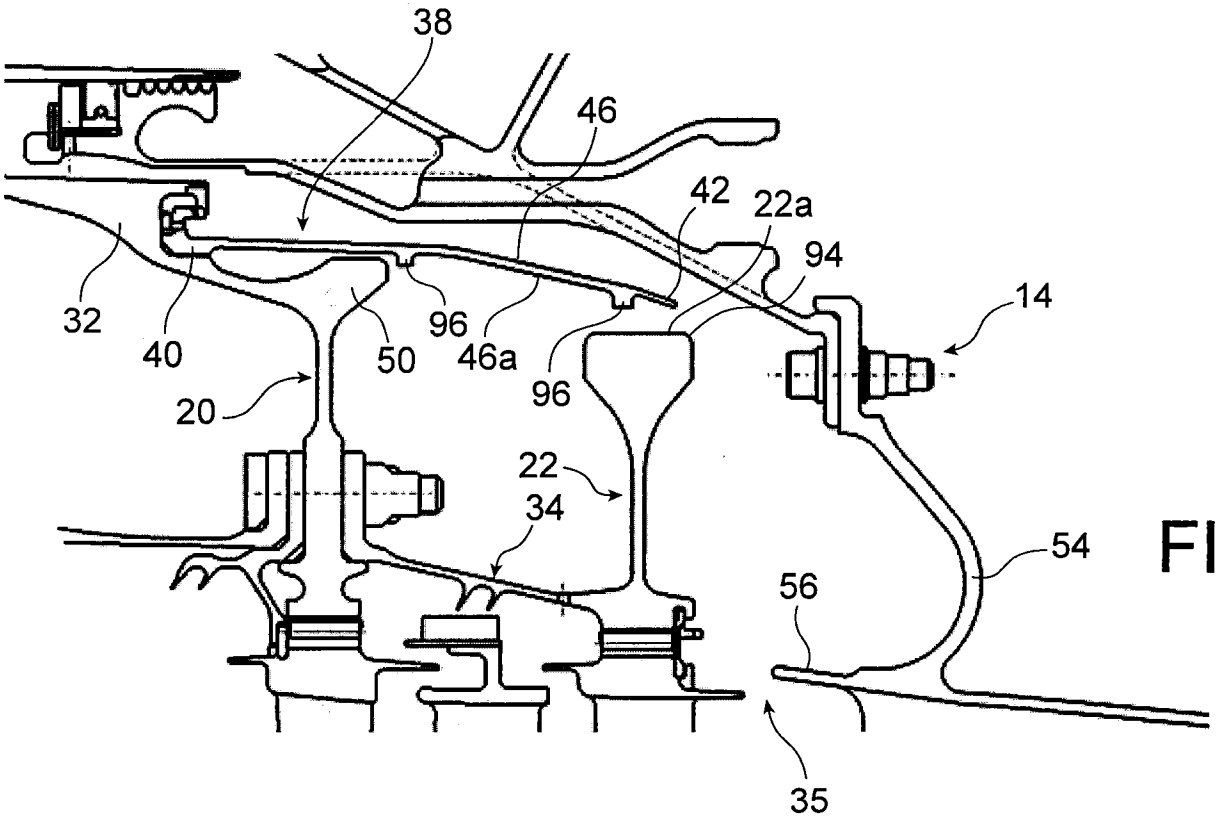
FIG. 6 is a view similar to that of FIG. 1 showing a fifth embodiment of the revolution flange.

FIG. 6 further shows another alternative embodiment of the invention according to which the flange 38 covers the intermediate disc 20, the downstream disc 22 and the zone located between the intermediate disc 20 and the downstream disc 22.

The upstream end 40 of the flange 38 is integral with the revolution wall 32 which is located upstream of the intermediate disc 20.

Here, the means of fastening of the flange 38 on the revolution wall are of the so-called "clutch" type, i.e. similar to the means of fastening of the flange 38 to the downstream disc 22 such as described in reference to the embodiment shown in FIG. 5.

The downstream end 42 of the flange 38 is located axially on the downstream end edge 94 of the internal radial end surface 22*a* of the downstream disc 22.

This edge 94 is of rounded convex shape and is domed both radially towards the interior and axially in the downstream direction.

As such, the liquid which flows from the downstream end 42 of the flange 38 falls onto this edge of the disc 22 and then flows naturally in the direction of the space 35 separating the downstream end of the rotor 12 from the stator 14, thanks to this domed shape of the edge 94 and by the centrifugal action produced by the rotation of the rotor 12.

In order to limit the vibrations of the flange 38 during its rotation, annular ribs 96 are distributed over the radially external surface 46*a* of the tapered portion 46.

The ribs make it possible to partially rigidify the flange 38, without having an influence on the flow of the liquid, which takes place on the radially internal surface of the tapered portion 46.

The invention claimed is:

1. An arrangement for guiding a flow of liquid, wherein said liquid flows from a tank of liquid mounted on a stator of a turbomachine, in relation to a rotor of the turbomachine, to a space separating a downstream end of the rotor from the stator, consisting of an axial play located between an annular flange of the downstream end of the rotor and a flange of the stator that delimits a stream of circulation of combustion gas, downstream of the turbine, wherein the rotor comprises an intermediary disc and a downstream disc, located downstream of the intermediate disc, adjacent of revolution of which an external radial end edge of each disc carries vanes, of which an internal diameter and an axial position of the discs are defined in such a way that the tank is arranged inside said intermediary and downstream discs, wherein a guide flange for the liquid is arranged between the tank and the discs, wherein the guide flange comprises an element of revolution supported by the rotor, of which a diameter of a section increases in a downstream direction, according to a direction of flow of gases in the turbomachine, and wherein said guide flange extends axially at least starting from the intermediate disc to the downstream disc.

2. The arrangement as claimed in claim 1, wherein the downstream axial end of the guide flange is fixed to the annular flange of the downstream end of the rotor located downstream of the downstream disc and an upstream axial end of the guide flange is connected to an internal radial end of the intermediate disc.

3. The arrangement as claimed in claim 2, wherein the annular flange of the downstream end of the rotor comprises a radially internal collar whereon the axial downstream end of the guide flange is fixed.

4. The arrangement according to claim 2, wherein the internal radial end of the intermediate disc comprises an annular groove open axially in the downstream direction wherein the upstream end of the guide flange is received.

5. The arrangement according to claim 1, wherein an upstream axial end of the guide flange is connected to an internal radial end of the intermediate disc and the downstream axial end of the guide flange is fixed to an internal radial end of the downstream disc.

6. The arrangement as claimed in claim 5, wherein the downstream axial end of the guide flange is fixed to the internal radial end of the downstream disc by means of blocking in rotation and means of blocking in translation in relation to a main axis of the turbomachine.

7. The arrangement as claimed in claim 6, wherein the means of blocking in rotation comprise a plurality of axial pins which are received in complementary orifices of the internal radial end of the downstream disc and of the downstream end of the guide flange, and wherein the means of blocking in translation comprise retaining rings which axially clamp the downstream end of the guide flange against the internal radial end of the downstream disc.

8. The arrangement according to claim 5, wherein the internal radial end of the intermediate disc comprises a revolution ring extending in a protruding manner in the upstream direction in relation to the internal radial end of the intermediate disc, against a radially external annular surface from which the upstream end of the guide flange is radially engaged.

9. The arrangement according to claim 1, wherein the guide flange extends axially in the downstream direction starting from the intermediate disc, and the downstream axial end of the guide flange is located radially opposite and at a distance from an internal radial end surface of the downstream disc.

10. The arrangement as claimed in claim 9, wherein an upstream axial end of the guide flange is fixed to the intermediate disc by screwing.

11. The arrangement according to claim 9, wherein a diameter of a section of the internal radial end surface of the downstream disc increases in the downstream direction.

12. The arrangement according to claim 9, wherein the downstream disc comprises a downstream spout which extends the internal radial end surface of the downstream disc and which is curved radially outward.

13. The arrangement according to claim 1, wherein a downstream axial end of the guide flange is located radially opposite and at a distance from an internal radial end surface of a most downstream disc, and an upstream axial end of the guide flange is integral with the intermediate disc by means of fastening of the guide flange with the intermediate disc in rotation around a main axis of the turbomachine and by means of blocking in translation along the main axis of the turbomachine.

14. The arrangement as claimed in claim 13, wherein the means of fastening of the guide flange in rotation with the intermediate disc comprise a first revolution portion which is a part of the intermediate disc and a second revolution portion which is a part of the upstream end of the guide flange which cooperate with each other.

15. The arrangement according to claim 13, wherein the means of blocking in translation comprise a retaining ring coaxial with the main axis of the turbomachine, which cooperates with the intermediate disc and with the upstream end of the guide flange.

16. The arrangement according to claim 1, wherein the guide flange extends axially in the downstream direction starting from a revolution wall of the rotor, and the downstream axial end of the guide flange is located axially on a downstream end edge of an internal radial end surface of the downstream disc, which is of rounded shape axially domed in the downstream direction and radially inwards.

17. The arrangement as claimed in claim 16, wherein the guide flange comprises a tapered portion located between an upstream axial end and a downstream axial end of the guide flange, wherein the guide flange comprises at least one annular rib arranged on the radially external surface of the tapered portion.

18. The arrangement according to claim 1, wherein the stator comprises a casing delimiting a downstream portion of a stream of circulation of combustion gas, which is arranged downstream and at a distance of the rotor, wherein the downstream end of the guide flange is located axially on an axial space separating the rotor from the casing.

19. The arrangement as claimed in claim 18, wherein the casing is connected to the stator by a radial revolution wall, wherein the casing comprises a portion located upstream of the radial revolution wall, and located opposite the rotor, and said upstream portion comprises a drainage hole carried out on its lower end.

20. An aircraft turbomachine comprising an arrangement as claimed in claim 1.

* * * * *